US006513961B2

(12) United States Patent
Nagai et al.

(10) Patent No.: US 6,513,961 B2
(45) Date of Patent: Feb. 4, 2003

(54) LAMP UNIT

(75) Inventors: Kentaro Nagai, Shizuoka (JP); Yuji Hatagishi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/945,810

(22) Filed: Sep. 5, 2001

(65) Prior Publication Data

US 2002/0027784 A1 Mar. 7, 2002

(30) Foreign Application Priority Data

Sep. 5, 2000 (JP) ..... 2000-268937

(51) Int. Cl.[7] ..... F21S 8/10; H01R 13/58
(52) U.S. Cl. ..... 362/549; 362/490; 439/456
(58) Field of Search ..... 439/449, 456, 439/459, 470; 362/95, 503, 490, 548, 549

(56) References Cited

U.S. PATENT DOCUMENTS

| | | | | | |
|---|---|---|---|---|---|
| 3,670,094 | A | * | 6/1972 | Mattson | 439/449 |
| 4,214,135 | A | * | 7/1980 | Munroe | 439/456 |
| 4,821,161 | A | * | 4/1989 | Koontz | 439/456 |
| 5,408,394 | A | * | 4/1995 | Mandy | 439/470 |

* cited by examiner

*Primary Examiner*—Alan Cariaso
(74) *Attorney, Agent, or Firm*—Sughrue Mion, PLLC

(57) ABSTRACT

A lamp unit for mounting in a lamp mounting window formed in an interior wall member covering a vehicle body panel, the lamp unit includes: a wire connection terminal; a wire fastened to the wire connection terminal and installed on the interior wall member; and bent portions formed respectively at portions of the wire adjacent to the lamp unit so that the bent portions are engaged respectively with predetermined positioning projections formed on a fastening stand for positioning the wire to a wire connection portion of the wire connection terminal.

2 Claims, 5 Drawing Sheets

LAMP UNIT

BACKGROUND OF THE INVENTION

1. Technical Field of the Invention

The invention relates to a lamp unit, and more particularly to a structure in which the displacement or the like of the wires is prevented when wires are fastened to wire connection terminals of the lamp unit mounted in a lamp mounting window formed in an interior wall member covering a vehicle body panel.

2. Related Art

When a lamp unit, such as a room lamp and a courtesy lamp, is mounted on an interior wall member (such as a roof trim and a door trim) covering a vehicle body panel, the lamp unit is heretofore mounted in a lamp mounting window formed in the interior wall member.

As shown in FIG. 5, a room lamp 60 is a lamp unit which is mounted in a lamp mounting window (not shown) formed in a roof trim covering a body roof (not shown).

The room lamp 60 mainly comprises a lamp housing 61, an electric bulb 63, and a cover lens 62. After the electric bulb 63 is attached to a lamp mounting portion of the lamp housing 61, the cover lens 62 is attached to the lamp housing 61.

As shown in FIG. 6, one end portion of a wire harness 67 is press-connected directly to press-connecting terminals 66 of bus bars 69 provided in a wire connection recess 65 in the lamp housing 61 of the room lamp 60 by the use of a retaining piece 68. Therefore, the electric bulb 63 is electrically connected to the wire harness 67 installed on the body roof through the bus bars 69 which serve as wire connection terminals and are provided within the lamp housing 61.

Then, the lamp housing 61 is mounted directly on the body roof by bolts 64 through mounting brackets 61*a* formed on the outer periphery of a bottom plate of this lamp housing. The wire harness 67, integrated with the room lamp 60, extends toward a lower portion of a vehicle body along a predetermined path, and is connected at the other end thereof to another wire harness by a connector. Then, the roof trim is fixedly mounted on the body roof, thus completing the mounting operation. At this time, an outer surface (lower surface in FIG. 5) of the cover lens 62 of the room lamp 60 is exposed to the vehicle interior through the lamp mounting window formed in the roof trim (not shown).

However, in the above related room lamp 60, when the one end portion of the wire harness 67 is press-connected to the press-connecting terminals 66 provided in the lamp housing 61, the wire harness 67 is liable to be displaced relative to the press-connecting terminals 66, and the press-connecting operation and the holding of the end portion of the wire harness 67 during the press-connecting operation need to be carefully effected.

There are occasions when a plurality of lamp units, such as the room lamp 60 and a map lamp, are interconnected by wire harnesses 67, and these wire harnesses 67 are integrated with each other to provide a roof harness. In this case, when the position of connection of the wire harness 67 fastened to the wire connection terminals of each lamp unit is displaced in the longitudinal direction relative to the wire connection terminals, there arises a possibility that each lamp unit can not be mounted in the proper position on the body roof.

SUMMARY OF THE INVENTION

It is therefore an object of this invention to solve the above problems, and more specifically to provide a lamp unit in which wires can be easily and accurately positioned and fastened relative to wire connection terminals of the lamp unit.

The object of this invention has been achieved by a lamp unit for mounting in a lamp mounting window formed in an interior wall member covering a vehicle body panel, the lamp unit comprising:

a wire connection terminal;

a wire fastened to the wire connection terminal and installed on the interior wall member; and bent portions formed respectively at portions of the wire adjacent to the lamp unit so that the bent portions are engaged respectively with predetermined positioning projections formed on a fastening stand for positioning the wire to a wire connection portion of the wire connection terminal.

In this construction, the bent portions of the predetermined shape are beforehand formed respectively at those portions of the wire disposed adjacent to the lamp unit, and in the fastening operation, merely by engaging the bent portions respectively with the predetermined positioning projections formed on the fastening bed, the wire can be easily and accurately positioned relative to the wire connection portions of the wire connection terminals in the lamp unit.

Preferably, the lamp unit comprises a lamp function portion, having the wire connection terminals, and a design portion, and the lamp function portion is resiliently supported so as to be displaced relative to the lamp mounting window in the interior wall member, and the wire, connected to the wire connection terminals, is retained and fixed to the interior wall member at those portions thereof disposed outwardly of the bent portions, respectively.

In this construction, the lamp function portion, connected to the wire beforehand installed on the interior wall member, is resiliently supported so as to be displaced relative to the lamp mounting window in the interior wall member, and therefore the lamp function portion can be mounted without rattling while absorbing its dislocation relative to the lamp mounting window, and therefore the mounting of the lamp function portion is easy.

At this time, the bent portions of the wire serve as extra-length portions which can be expanded and contracted in accordance with the dislocation of the lamp function portion, and therefore these bent portions prevent an undesirable pulling force from acting on the wire retained and fixed to the interior wall member.

DETAILED DESCRIPTION OF PREFERRED EMBODIMENT

One preferred embodiment of a lamp unit of the present invention will now be described in detail with reference to the accompanying drawings.

Figure 1:
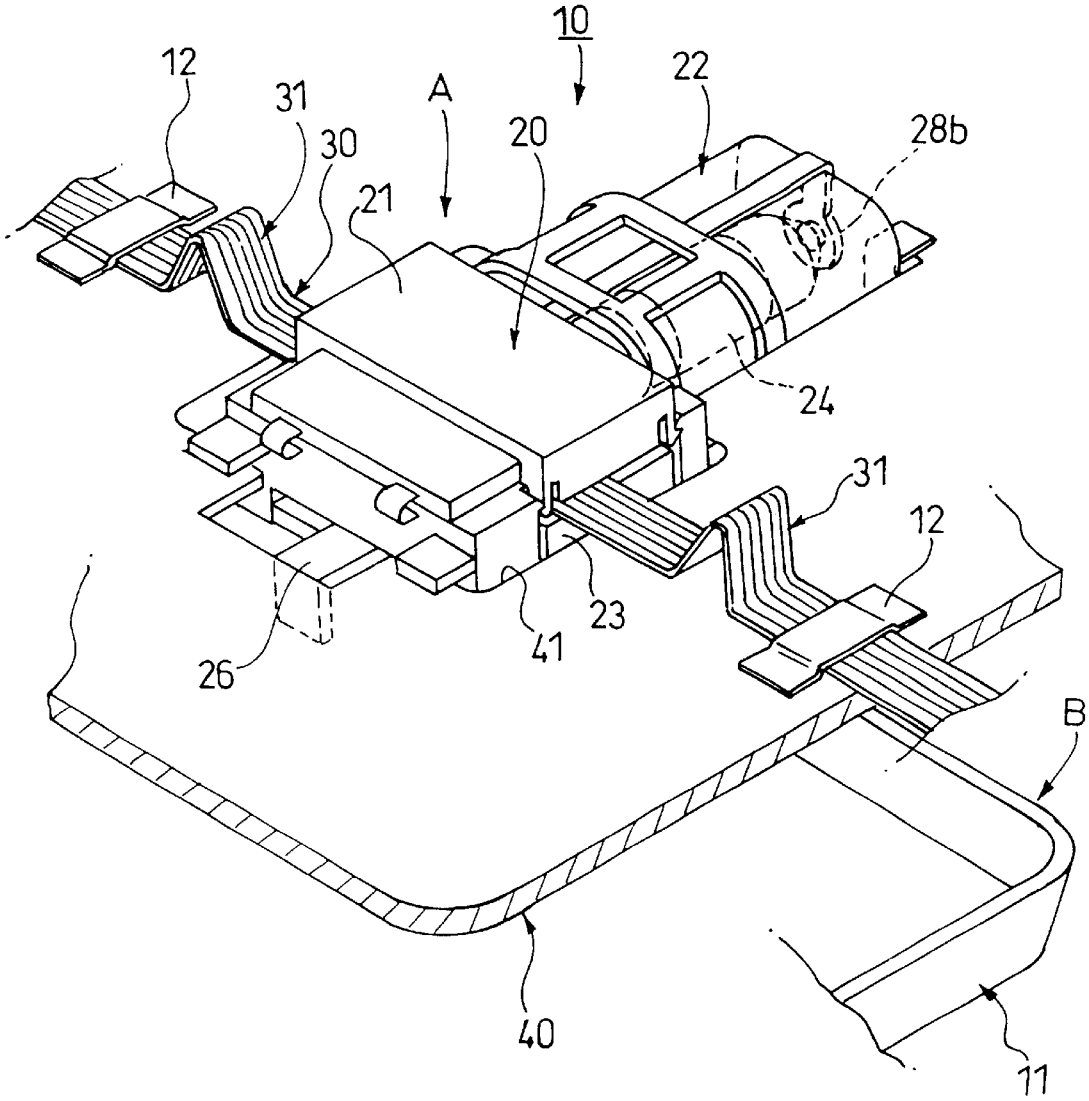
FIG. 1 is a perspective view of an important portion of one embodiment of a lamp unit of the invention, showing the process of mounting the lamp unit on a roof trim.
Figure 2:
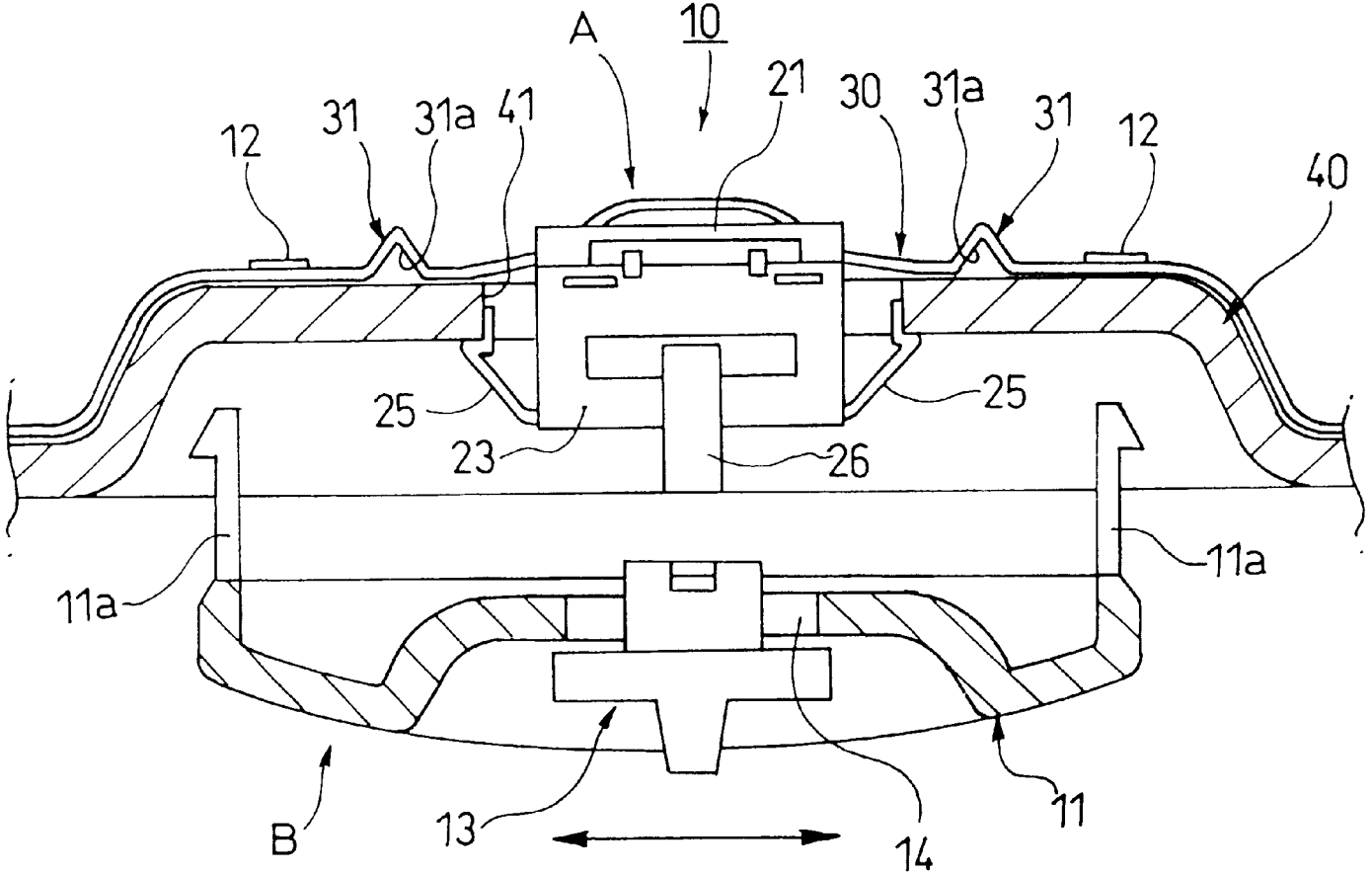
FIG. 2 is a transverse cross-sectional view of the lamp unit of FIG. 1.
Figure 3:
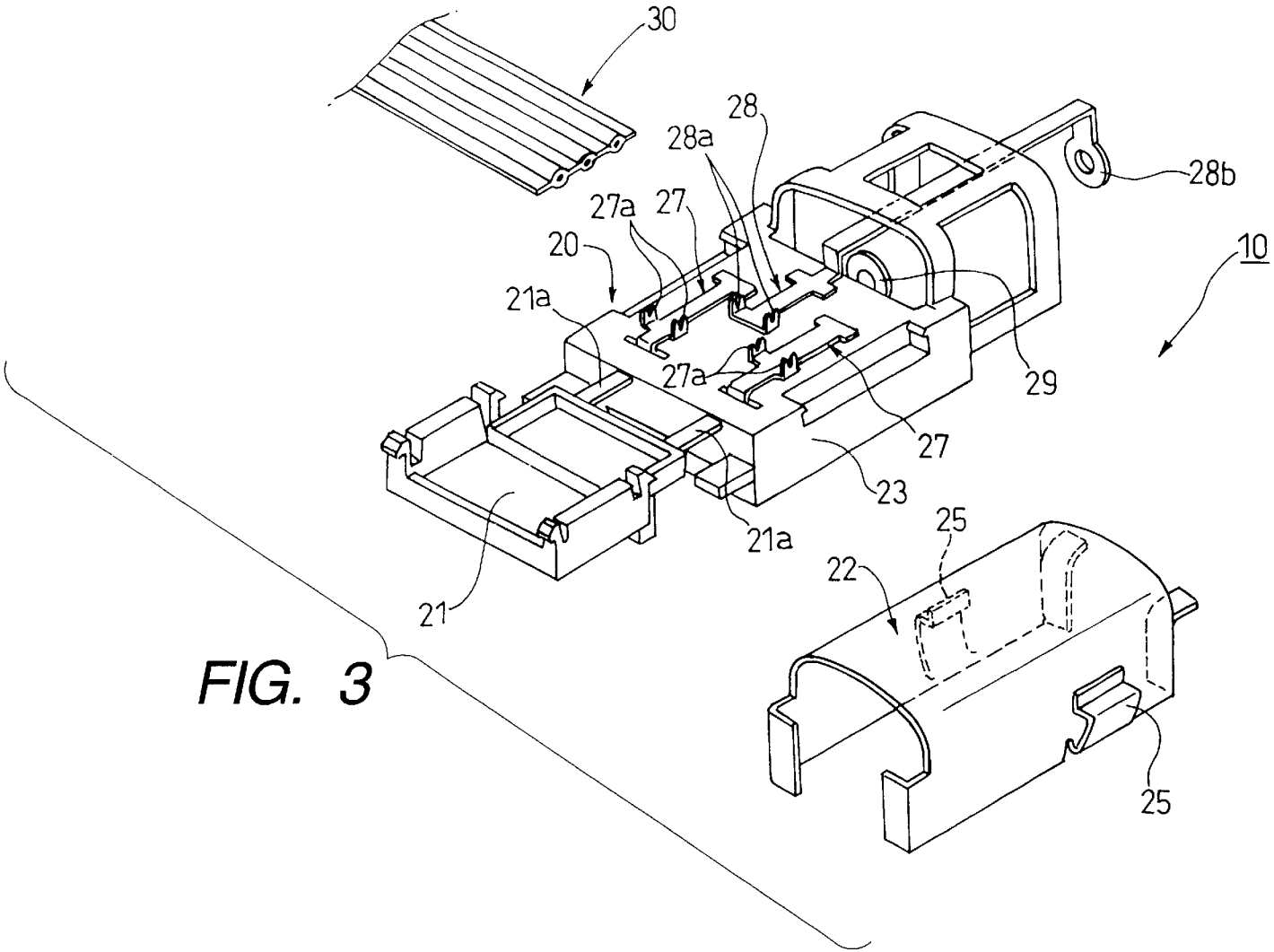
FIG. 3 is an exploded, perspective view of a lamp function portion of FIG. 1.

FIG. 1 is a perspective view of a substantial part in one embodiment of the lamp unit of the invention, showing the process of mounting the lamp unit on a roof trim, FIG. 2 is a transverse cross-sectional view of the lamp unit of FIG. 1, FIG. 3 is an exploded, perspective view of a lamp function portion of FIG. 1, and FIG. 4 is a cross-sectional view explanatory of an operation for press-connecting wires to the lamp function portion of FIG. 1.

A room lamp 10 in the embodiment, shown in FIGS. 1 to 3, is a lamp unit which is to be mounted in a lamp mounting window 41 formed in the roof trim 40 (serving as an interior wall member) covering a vehicle body panel (not shown).

As shown in FIGS. 1 to 3, the room lamp 10 is the lamp unit which comprises the lamp function portion A to be mounted on a vehicle body panel-side of the roof trim 40, and a design portion B to be mounted on a room-side of the roof trim 40. The lamp function portion A comprises a switch unit 20 having bulb contacts 28*b* and 29, a bulb (electric bulb) 24 mounted between the two bulb contacts 28*b* and 29, and a reflector 22. The design portion B comprises a cover lens 11.

The reflector 22 is a reflective member of an integral construction formed from a sheet of metal (e.g. stainless steel) by pressing or the like, and this reflector has the function of effecting the optimum luminous distribution of the bulb 24, and also functions as a structure support member for the lamp function portion A.

A pair of trim mounting portions 25 and 25 for engaging with the lamp mounting window 41 in the roof trim 40 are formed in a bent manner at lower edges of opposite side walls of the reflector 22, respectively.

As shown in FIG. 3, in the switch unit 20, a switching circuit (not shown) connected to the two bulb contacts 28*b* and 29 is accommodated in an insulating housing 23. The two bulb contacts 28*b* and 29 are exposed to the exterior. Press-connecting terminals 27*a* and 28*a*, serving as wire connection portions, of wire connection terminals 27 and 28 of the switching circuit are exposed to the exterior in a projected manner.

The press-connecting terminals 27*a* and 28*a* are provided on an upper surface of the insulating housing 23 in such a manner that their press-connecting blades are directed in the same direction and are disposed parallel to one another. An FFC (flexible flat cable) 30 formed by wires forming a roof harness beforehand installed on the roof trim 40 is press-connected to the press-connecting terminals 27*a* and 28*a* by a press-connecting apparatus 55 (described later).

The switch unit 20 is provided with a switch lever 26 for activating and deactivating the switching circuit so as to turn on and off the bulb 24.

A strain relief cover 21 serving as wire fixing member is formed integrally with the insulating housing 23 through flexible hinges 21*a* and 21*a* by molding.

Simultaneously when the switch unit 20 and the reflector 22 are combined together in an integrated manner, the FFC 30 is press-connected to the terminals, and then the bulb 24 is inserted between the opposed two bulb contacts 28*b* and 29, so that the lamp function portion A is assembled.

The press-connecting apparatus 55 for press-connecting the FFC 30 to the press-connecting terminals 27*a* and 28*a* of the switch unit 20 comprises a press-connecting stand 50, having a holding recess 51 for releasably receiving the switch unit 20 to hold the same in a positioned condition, and a press-connecting punch 53 which is movable downward so as to press-connect the FFC 30, placed above the press-connecting terminals 27*a* and 28*a*, to these terminals.

Predetermined positioning projections 52 and 52 are formed on the press-connecting stand 50, and are disposed adjacent to opposite side edges of the holding recess 51, respectively.

The FFC 30 is press-connected to the press-connecting terminals 27*a* and 28*a* of the switch unit 20 and is installed on the vehicle body panel-side of the roof trim 20. A pair of bent portions 31 and 31 is respectively formed at portions of the FFC 30 adjacent to the switch unit 20. Each bent portion has a predetermined shape (triangular mountain-like shape in the embodiment) for positioning the FFC 30 with respect to the press-connecting terminal 27*a*, 28*a* of the wire connection terminals 28 and 28 in predetermined position by engaging with the positioning projections 52 and 52.

Next, description will be made of the procedure of the fastening operation for press-connecting the FFC 30 to the wire connection terminals 27 and 28 of the switch unit 20.

Figure 4A:
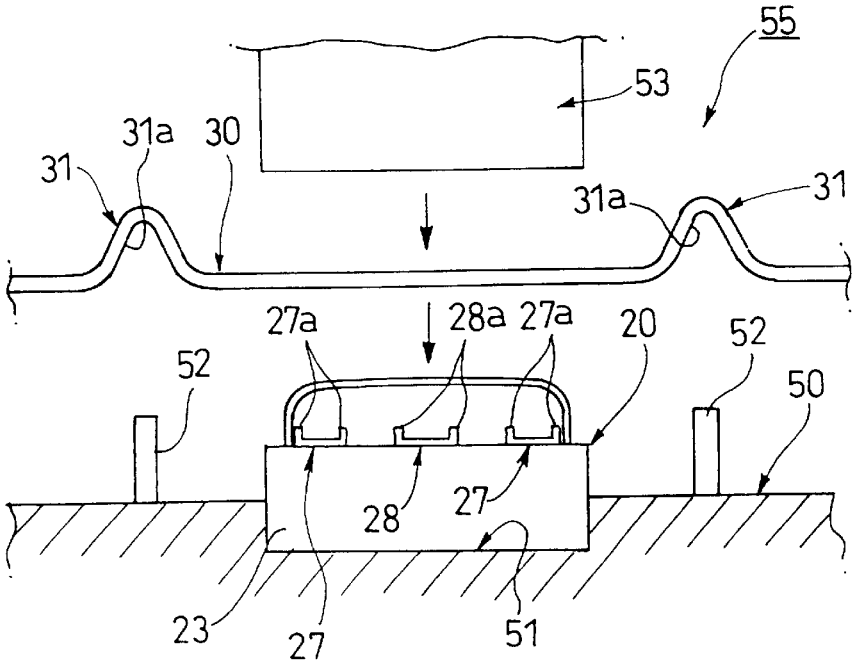
FIGS. 4(A) and 4(B) are cross-sectional views explanatory of an operation for press-connecting wires to the lamp function portion of FIG. 1.

First, the switch unit 20 is fitted into the holding recess 51 formed in the press-connecting stand 50 of the press-connecting apparatus 55, as shown in FIG. 4A.

Then, the FFC 30 is placed on the press-connecting terminals 27*a* and 28*a* of the switch unit 20 in such a manner that the positioning projections 52 are engaged respectively in recesses 31*a* formed respectively by the bent portions 31 and 31 of the FFC 30.

At this time, the positioning projections 52 are engaged respectively in the recesses 31*a* of the FFC 30, so that the FFC 30 is located in the predetermined position with respect to the switch unit 20. Therefore, the displacement of the connecting position due to wrong registration, as well as the displacement due to vibrations developing during the press-connecting operation, is positively prevented.

Figure 4B:
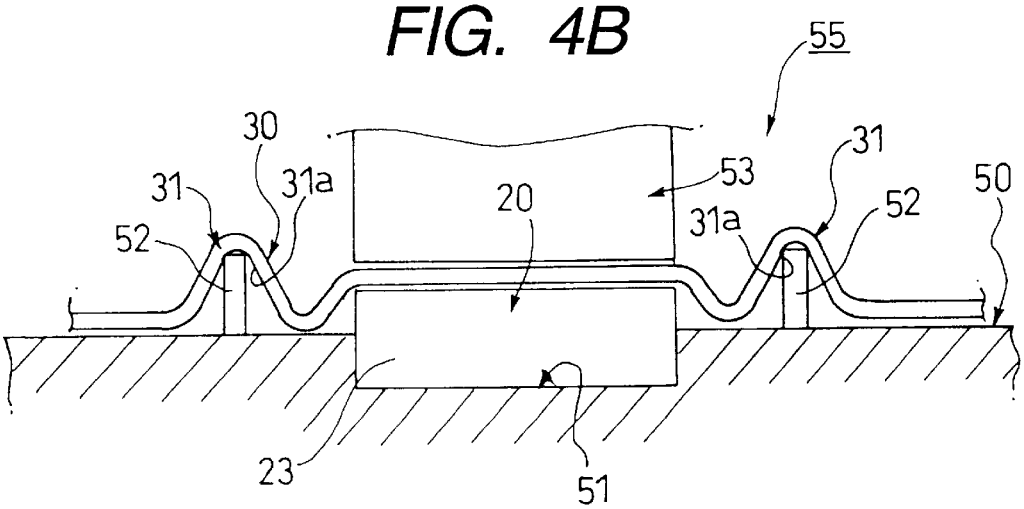
Figure 5:
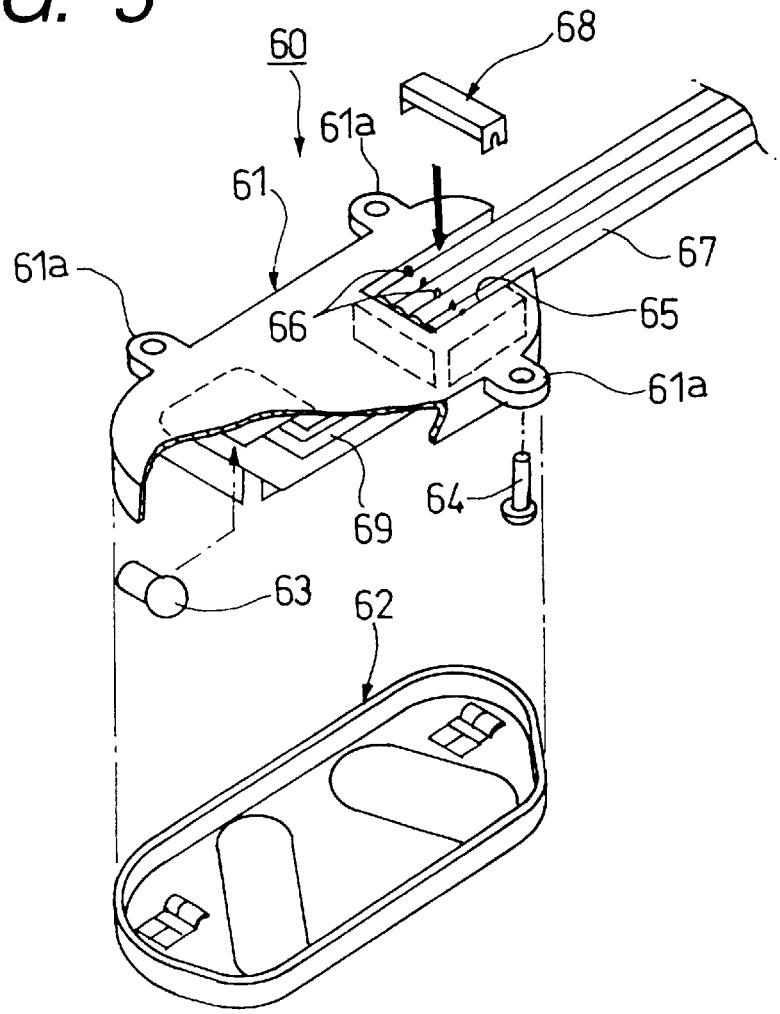
FIG. 5 is an exploded, perspective view of a conventional lamp unit.
Figure 6:
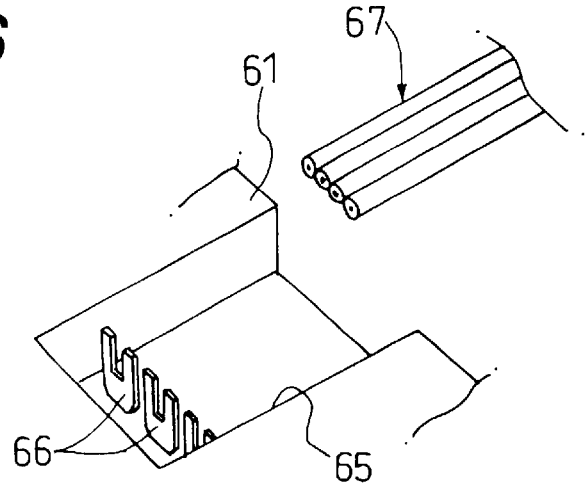
FIG. 6 is an exploded, perspective view of an important portion of the lamp unit of FIG. 5.

In this condition, the press-connecting punch 53 is moved downward, thereby pressing the FFC 30 against the press-connecting terminals 27*a* and 28*a* of the switch unit 20, as shown in FIG. 4B. As a result, conductors of the FFC 30 are press-connected respectively to the press-connecting terminals 27*a* and 28*a*, and therefore are electrically connected thereto.

Namely, in the room lamp 10 in the embodiment, the bent portions 31 are beforehand formed respectively at the portions of the FFC 30 which are to be disposed adjacent to the switch unit 20, and in the press-connecting operation, merely by engaging the predetermined positioning projections 52 (formed on the press-connecting stand 50) respectively in the recesses 31*a* of the bent portions 31, the FFC 30 can be easily and accurately positioned relative to the press-connecting terminals 27*a* and 28*a* of the wire connection terminals 27 and 28 in the room lamp 10. Therefore, the displacement of the FFC 30 with respect to the switch unit 20 during the press-connecting operation can be positively prevented.

For forming a roof module by beforehand mounting the room lamp 10 in the embodiment on the roof trim 40 as shown in FIGS. 1 and 2, the lamp function portion A comprising the switch unit 20 connected to the predetermined portion of the FFC 30, and the reflector 22 is first mounted in the lamp mounting window 41 formed in the roof trim 40.

At this time, the trim mounting portions 25 of the reflector 22 are resiliently engaged with the portions of the edge of the lamp mounting window 41 opposed respectively to these trim mounting portions 25, so that the lamp function portion A is directly mounted on the roof trim 40 without rattling, and therefore the lamp function portion A can be easily mounted. The lamp function portion A can be displaced relative to the roof trim 40 within the lamp mounting window 41 against the resilient forces of the trim mounting portions 25.

As shown in FIGS. 1 and 2, the FFC 30, which is press-connected to the wire connection terminals 27 and 28, and is installed on the vehicle body panel-side of the roof trim 40, is retained and fixed to the roof trim 40 by fixing member, such as adhesive tapes 12, at those portions thereof disposed outwardly of the bent portions 31, respectively.

On the other hand, the cover lens 11 forming the design portion B of the room lamp 10 is mounted on and covers the lamp function portion A, beforehand mounted in the lamp mounting window 41, from the room-side of the roof trim 40, as shown in FIG. 2. More specifically, the retaining projections 11*a* formed on a peripheral wall of the cover lens 11 are engaged respectively in engagement holes in the roof trim 40, so that the cover lens 11 is mounted on and covers the lamp mounting window 41 in the roof trim 40.

A switch knob 13 is beforehand slidably fitted in a slide groove 14 formed in the cover lens 11. When the cover lens 11 is mounted on and covers the lamp mounting window 41, the switch knob 13 is engaged with a distal end of the switch lever 26. Therefore the switch lever 26 is operated through this switch knob 13.

Namely, in the room lamp 10 in the embodiment, the lamp function portion A connected to the FFC 30 beforehand installed on the vehicle body panel-side of the roof trim 40 is resiliently supported by the trim mounting portions 25 and 25 so as to be displaced relative to the lamp mounting window 41 in the roof trim 40, as shown in FIG. 2. Therefore this lamp function portion can be mounted without rattling while absorbing its displacement relative to the lamp mounting window 41, and therefore the mounting of the lamp function portion A is easy.

Then, the cover lens 11 is fixed from the inside of the room to cover the lamp mounting window 41.

At this time, if the precision of molding of the roof trim 40 is low, the lamp function portion A is sometimes displaced relative to the lamp mounting window 41. However, the bent portions 31 of the FFC 30 serve as extra-length portions which can be expanded and contracted in accordance with the displacement of the lamp function portion A. Therefore these bent portions 31 can absorb this dislocation.

Therefore, though the FFC 30 is retained and fixed to the roof trim 40 by the adhesive tapes 12, the FFC 30 will not be pulled in the longitudinal direction in accordance with the dislocation of the lamp function portion A, and an undesirable pulling force will not act on the terminal-connected portion of the FFC press-connected to the press-connecting terminals 27*a* and 28*a*. Therefore, the defective connection will not be incurred.

In the lamp unit of the present invention, the constructions of the lamp function portion, the wire connection terminals, the wire connection portions, the bent portions of the wire and so on are not limited to those shown in the above embodiment, and each of these can take any other suitable form within the scope of the invention.

For example, in the above embodiment, although the room lamp 10 which is the lamp unit is mounted on the roof trim 40 serving as the interior wall member, the invention can be applied to a lamp unit such as a map lamp mounted on the roof trim, and a courtesy lamp mounted on a door trim (interior wall member) covering a door panel.

The wires installed on the interior wall member are not limited to the FFC of the above embodiment, but a flat circuit member, such as an FPC (flexible printed circuit board) and a ribbon wire, and a wire harness can be used.

The wire connection portions provided at the lamp function portion of the lamp unit are not limited to the press-connecting terminal structure of the above embodiment, but any other suitable fastening means, such as a piercing terminal structure and a welding structure, can be used.

As described above, in the lamp unit of the present invention, the bent portions of the predetermined shape are beforehand formed respectively at those portions of the wire disposed adjacent to the lamp unit, and in the fastening operation, merely by engaging the bent portions respectively with the predetermined positioning projections formed on the press-connecting stand, the wire can be easily and accurately positioned relative to the wire connection portions of the wire connection terminals in the lamp unit.

Therefore, the dislocation of the wire connecting position due to wrong registration in the fastening operation, as well as the dislocation due to vibrations developing during the press-connecting operation, is positively prevented, and the efficiency of the lamp unit-mounting operation, as well as its quality, is enhanced.

What is claimed is:

1. A lamp unit for mounting in a lamp mounting window formed in an interior wall member covering a vehicle body panel, the lamp unit comprising:

a wire connection terminal;

a wire fastened to the wire connection terminal and installed on the interior wall member; and pre-bent portions formed respectively at portions of the wire adjacent to the lamp unit so that the pre-bent portions are engaged respectively with predetermined positioning projections formed on a fastening stand for positioning the wire to a wire connection portion of the wire connection terminal.

2. The lamp unit according to claim 1, wherein the lamp unit comprises a lamp function portion disposed above the interior wall member having the wire connection terminal and a design portion disposed below the interior wall member, the lamp function portion is resiliently supported to be displaced with respect to the lamp mounting window, and the wire connected to the wire connection terminal is retained to the interior wall member at portions of the wire disposed outwardly of the pre-bent portions, respectively.

* * * * *